US005341122A

United States Patent [19]

Rickman

[11] Patent Number: 5,341,122

[45] Date of Patent: Aug. 23, 1994

[54] PRESSURE ACTUATED GLASS BREAK SIMULATOR

[75] Inventor: Stephen R. Rickman, Loomis, Calif.

[73] Assignee: C & K Systems, Inc., Folsom, Calif.

[21] Appl. No.: 901,864

[22] Filed: Jun. 22, 1992

[51] Int. Cl.[5] ..... G08B 29/00

[52] U.S. Cl. ..... 340/515; 340/514; 340/566

[58] Field of Search ..... 340/515, 514, 566, 550, 340/590; 73/1 D, 1 DV, 11, 12.01

[56] References Cited

U.S. PATENT DOCUMENTS 4,668,941 5/1987 Davenport et al. ..... 340/566
5,164,703 11/1993 Rickman ..... 340/566
5,192,931 3/1993 Smith et al. ..... 340/550

*Primary Examiner*—Donnie L. Crosland
*Attorney, Agent, or Firm*—Limbach & Limbach

[57] ABSTRACT

A glass break simulator responds to a low-frequency sound component of the sound of breaking glass produced by striking the glass. The glass break simulator detects the low-frequency sound component and when an amplitude of the low-frequency sound component exceeds a predetermined threshold value, the simulator generates a high-frequency sound component by converting a digital representation of the high-frequency sound component into sound. The low-frequency sound component and the generated high-frequency sound component are directed at a glass break detector to test it, with the glass break detector responsive to both low and high-frequency sound components.

17 Claims, 5 Drawing Sheets

| | |
|---|---|
| FIG. 2A | FIG. 2B |
| FIG. 2C | FIG. 2D |

KEY TO FIG. 2

PRESSURE ACTUATED GLASS BREAK SIMULATOR

BACKGROUND OF THE INVENTION

1. Field of the Invention

The present invention relates to a device which simulates the sound of breaking glass and, in particular, to a device which is actuated by pressure.

2. Description of the Related Art

Intrusion alarms are devices which generate an alarm signal when an unauthorized entry into a protected structure is detected. One common method for gaining access into the protected structure is to break out a window. In response to this, glass break detectors have been developed to generate an alarm signal when the sound of breaking glass is detected.

When glass mounted in the wall of a room is broken by impact, many variables affect the sound that is produced. Some of these variables are the type of glass, its size, the mounting method, and the acoustic properties of the room. However, for all glass broken by impact, the acoustic signal that results is a short-term event typically lasting from one-half to three seconds. The peak amplitudes are concentrated in the initial portions of the signal. The frequency spectrum of the acoustic signal is very wide, ranging from as low as 3 Hz to well over 20 kHz. The low-frequency components of the signal are caused by the initial displacement of the glass as it rebounds from the blow. If the mounting frame and wall are flexible, they may contribute to the low-frequency components as well. The high-frequency components are caused by the emissions associated with the actual fracturing of the glass and secondarily by collisions of glass fragments with each other and with barriers in the room.

All glass break detectors which rely on detecting the sound of breaking glass operate by selectively detecting one or more of the frequency components associated with the sound of breaking glass. Some glass break detectors listen only for a narrow band of frequencies in the high end of the spectrum while others listen for both the high and low frequencies. The low-frequency is caused by the flexing of the window immediately prior to its breakage. Glass break detectors, like model FG-730 manufactured by C & K Systems, Inc., require the two components to have a defined duration and arrive nearly simultaneously before the acoustic signal is identified as a glass break. Using several glassbreak frequencies improves false-alarm immunity.

When a glass break detector is installed, it should be tested because the acoustic properties of a room may affect the range of the glass break detector. In a room containing highly absorptive materials such as carpets, drapes, and acoustical tile ceilings, the detection range for high-frequency components will be much less than in a room with hard, reflective walls, floors, and ceilings. Although ordinary absorptive materials do not affect low-frequency components of the acoustic signal (below about 500 Hz), the geometry of the room does. Rooms with larger enclosed volumes cause greater attenuation of low-frequency components with distance than occurs in smaller rooms.

In addition to the acoustic properties of the room, tolerance of components in the glass break detector may cause the actual detection range to be less than what is expected.

For glass break detectors which detect only the high-frequency sound components, relatively simple simulators can be fashioned which simulate the high-frequency sound components. For glass break detectors which detect both the high and low frequency sound components, installation testing becomes much more difficult for two reasons. First, it is difficult to design a compact device which can produce low-frequency sound components. Second, it is difficult to independently produce high and low frequency sound components which will arrive nearly simultaneously at a glass break detector.

SUMMARY OF THE INVENTION

In accordance with the present invention, a device and a method for producing high and low frequency sound components is disclosed. A low-frequency sound component is generated by striking a glass surface which is to be protected. The low-frequency sound component is then detected by the simulator of the present invention. The simulator generates a high-frequency sound component in response thereto.

DETAILED DESCRIPTION

An embodiment of a glass break simulator 10 according to the present invention will now be described with reference to the accompanying drawings.

Figure 1:
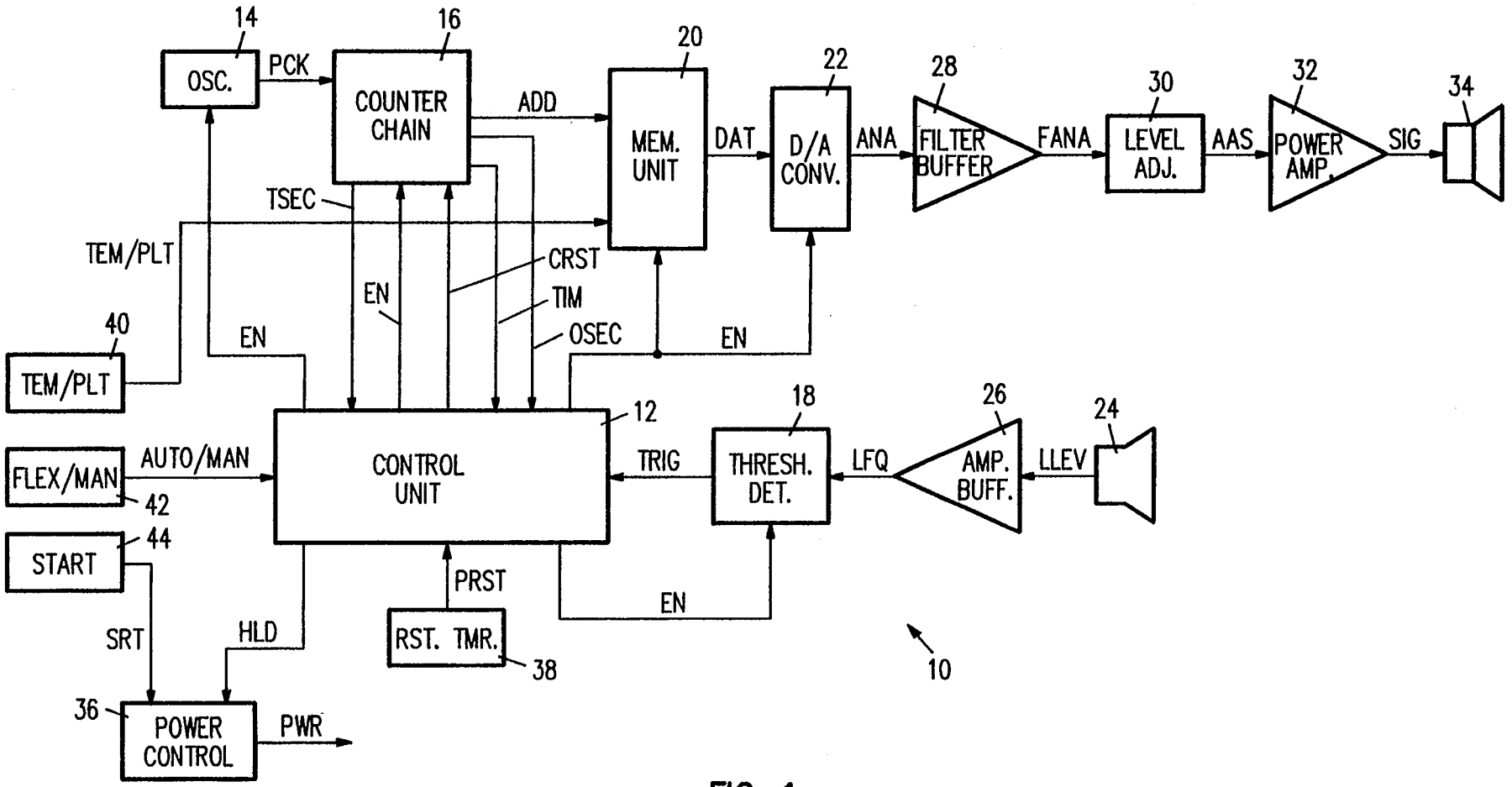
FIG. 1 shows a block diagram of the simulator circuit in accordance with the present invention.
Figure 2A:
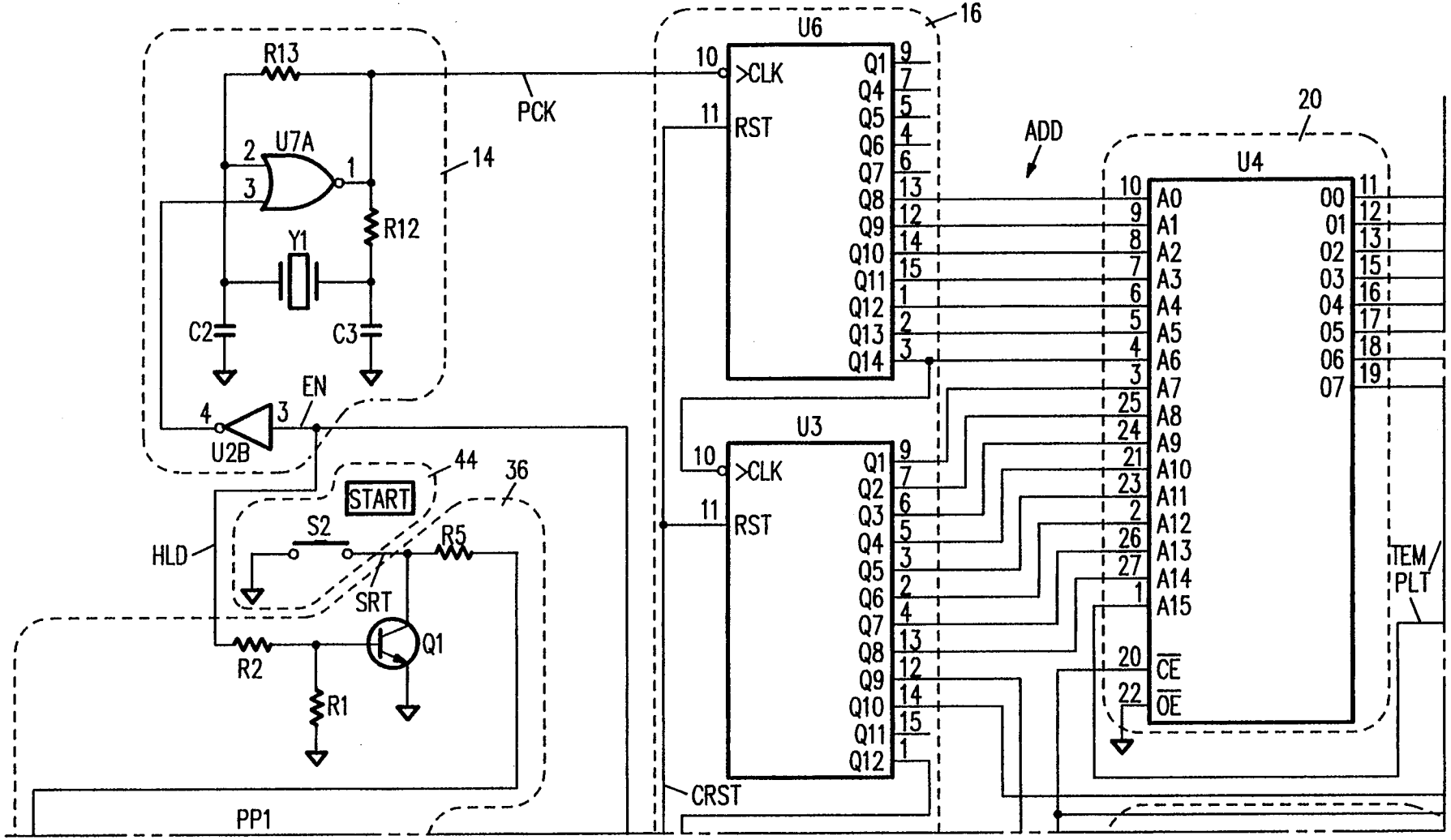
FIG. 2 shows a circuit diagram of the simulator in accordance with the present invention.
Figure 2B:
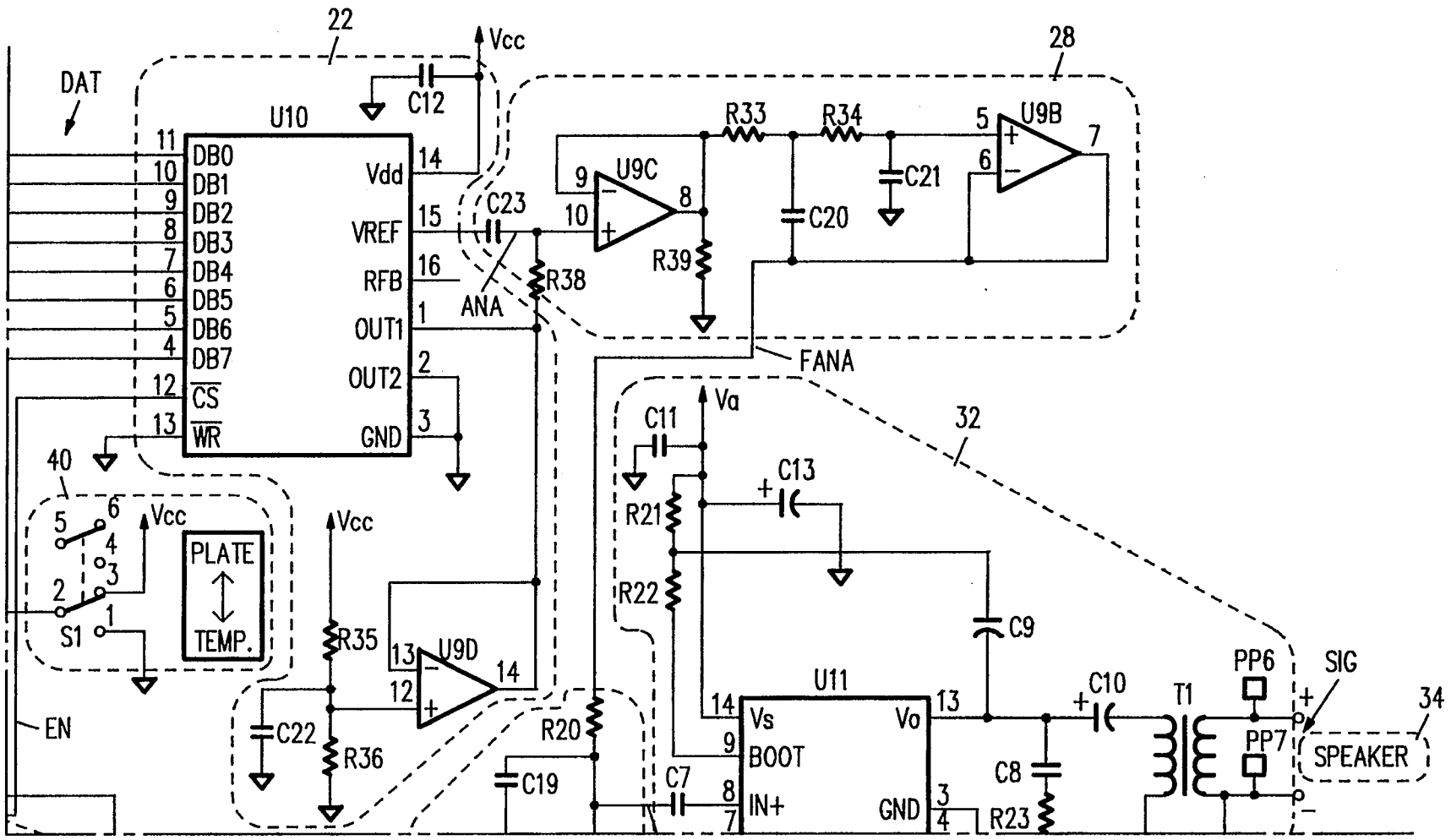
Figure 2C:
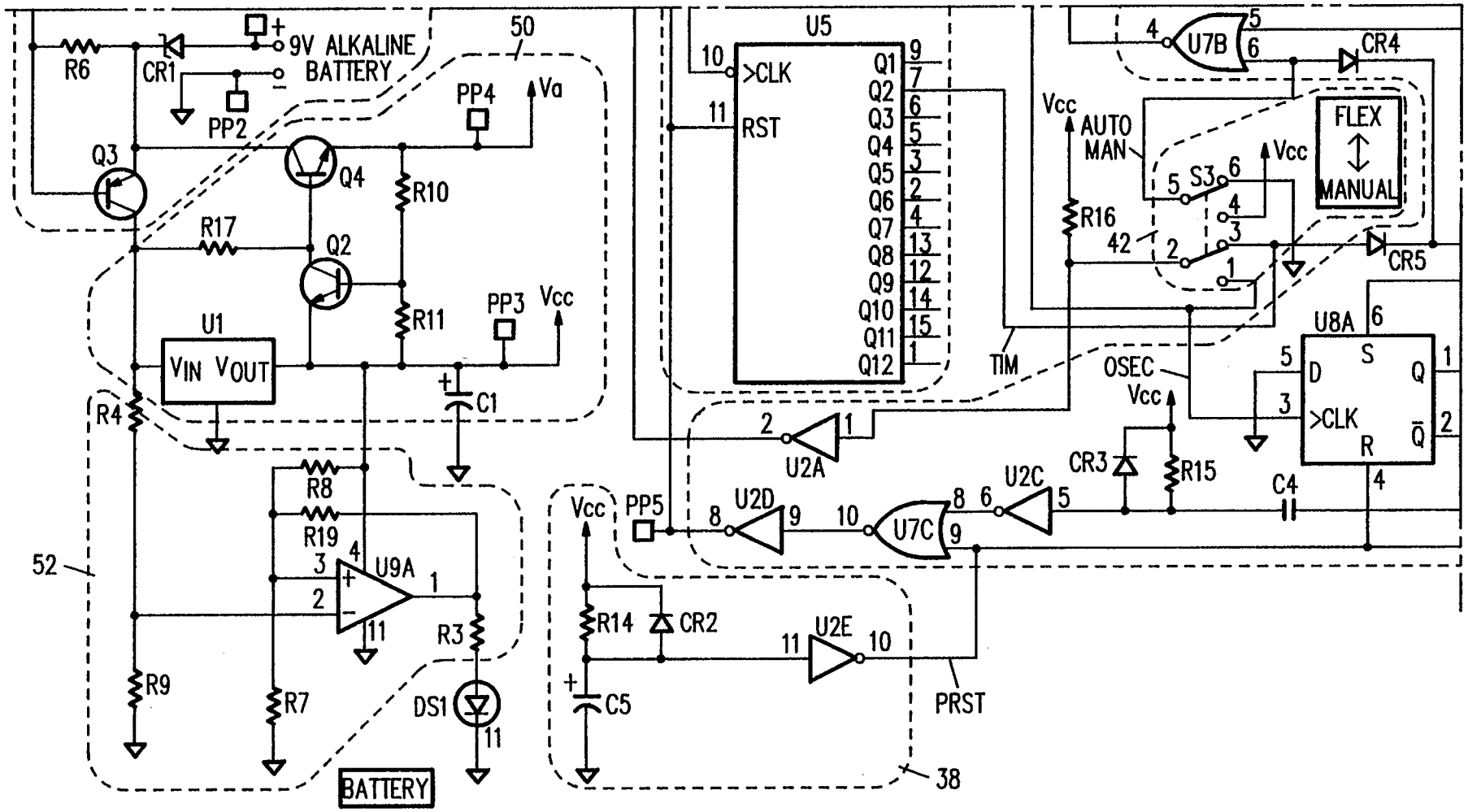
Figure 2D:
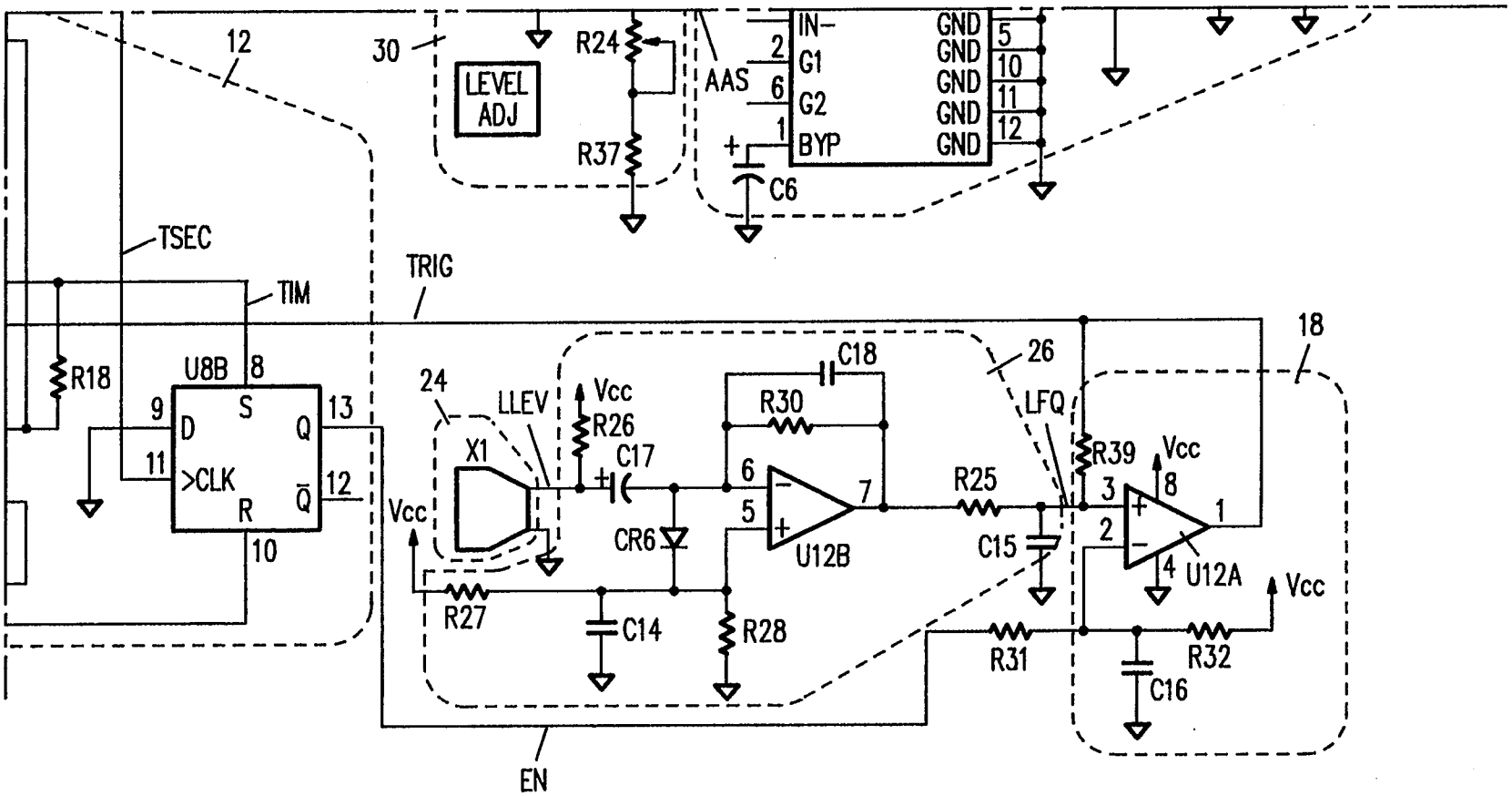

The glass break simulator 10 of the present invention may be configured to generate a high-frequency sound component in response to a detected low-frequency sound component or a manual command. Referring to FIG. 1, when the glass break simulator 10 is configured to respond to the detected low-frequency sound component and is initially energized, a control unit 12 transmits an enabling signal EN to a crystal-controlled clock oscillator 14 and a threshold detector 18.

When enabled, the oscillator 14, which is electrically coupled to the counter chain 16, begins generating a periodic clock signal PCK at a frequency of approximately 4.096 megahertz. The counter chain 16 receives the clock signal PCK and in response thereto generates three timing signals: a timeout signal TIM, a first signal OSEC, and a second signal TSEC and a sequential 15-bit digital address signal ADD at a 32 KHz rate. The timeout signal TIM, the first signal OSEC, and the second signal TSEC are transmitted to the control unit 12. Thus, the counter chain 16 generates the signals ADD, TIM, OSEC, and TSEC after being reset.

At the same time that the control unit 12 enables the oscillator 14, the control unit 12 resets the counter chain 16 by transmitting a reset signal CRST. In the preferred embodiment of the present invention, the timeout signal TIM is generated approximately 33 seconds after being reset, the first signal OSEC is generated one second after being reset, and the second signal TSEC is generated two seconds after being reset.

In addition to first enabling the oscillator 14 and threshold detector 18, the control unit 12 also disables a memory unit 20 and a D/A (digital to analog) converter 22. By disabling the memory unit 20, which is electrically coupled to the counter chain 16, and the D/A converter 22, which is electrically coupled to the memory unit 20, the control unit 12 prevents the high-frequency sound component from being generated.

After the control unit 12 has enabled and disabled the above described elements, the glass break simulator 10 enters a standby condition. If a low-frequency sound component is not detected by the glass break detector 10 within 33 seconds, the control unit will receive the timeout signal TIM, and in response thereto, deenergize the glass break simulator 10 (see below).

If, however, a low-frequency sound component of sufficient amplitude and frequency is received within the time period after the counter chain 16 is reset, the glass break simulator 10 will respond by producing a high-frequency sound component.

The low-frequency sound component is first detected by a microphone 24. The microphone 24, which is electrically coupled to an amplifier/filter unit 26, receives the low-frequency sound and generates a low-level electrical signal LLEV by converting the low-frequency sound into an electrical signal.

Next, the amplifier/filter unit 26, which is electrically coupled to a threshold detector 18, receives the low-level electrical signal LLEV and generates a low-frequency signal LFQ. The amplifier/filter unit 26 generates the low-frequency signal LFQ by filtering out frequencies above about 30 Hz and amplifying the result.

Following this, the threshold detector 18, which is electrically coupled to the control unit 12, receives the low-frequency signal LFQ and compares the amplitude of the low-frequency signal LFQ to a predetermined threshold value. When the amplitude of the low-frequency signal LFQ exceeds the threshold value, the threshold detector 18 generates a trigger signal TRIG which is transmitted to the control unit 12. The threshold detector 18 is preset to ignore low-level nuisance signals, but to detect a signal having an amplitude consistent with the striking of a nearby pane of glass.

When the control unit 12 detects the trigger signal TRIG, the control unit 12 disables the threshold detector 18 to prevent the generation of multiple trigger signals TRIG due to reverberations of the glass. At the same time that the threshold detector 18 is disabled, the control unit 12 resets the counter chain 16 and enables the memory unit 20 and the D/A converter 22.

When enabled, the memory unit 20, which receives the address signal ADD, begins to write out the data signals DAT associated with each address at a 32 kilohertz rate. The data stored in the memory unit 20 is a digital representation of the high-frequency sound component. The frequency components selected to be stored in the memory unit 20 corresponds to the frequency components that a particular glass break detector is tuned to receive.

In the preferred embodiment of the present invention, the memory unit 20, which is an EPROM, stores the high-frequency components of the sound of breaking plate and tempered glass. It should be apparent to one skilled in the art that the memory unit 20 could be configured to store fewer or additional frequency components so that the glass break simulator 10 of the present invention could operate with glass-break detectors produced by other manufacturers.

In the preferred embodiment of the present invention, the frequency components of the glass break sound are digitized at a 32 KHz rate. A one second sample of the digitized sound is then stored in the memory unit 20. The memory unit 20 is logically divided into two memory pages of 32,768 bytes. It should be apparent to one skilled in the art that the glass break sound may be digitized at different rates or that a lesser or greater sample could be stored in the memory unit 20. In addition, well known techniques of audio compression and bandwidth-shaping may be utilized to generate a high-frequency sound component that more nearly represents the actual sound of breaking glass. These techniques shift more energy into the high-frequency band where the glass break detectors are most sensitive.

To select between the frequency components associated with the sound of breaking plate or tempered glass, a plate/tempered switch 40 generates a plate signal PLT when the plate/tempered switch 40 is in the plate position and a tempered signal TEM when the switch 40 is in the tempered position. The memory unit 20 receives either the plate signal PLT or the tempered signal TEM and selects the memory page corresponding to the sound of plate glass or the sound of tempered glass, respectively.

To form the sound of breaking glass, the data signals DAT representing the high-frequency sound component are first converted into an analog signal ANA. The D/A converter 22, which is electrically coupled to the filter/buffer 28, receives the data signals DAT written out of the memory unit 20 and converts the data signals DAT into the analog signal ANA. The filter/buffer 28, which is electrically coupled to a level adjust unit 30, receives the analog signal ANA and generates a filtered signal FANA. The filter/buffer 28 generates the filtered signal FANA by attenuating the spurious high-frequency components in the analog signal ANA and transforming the analog signal ANA from a high-impedance to a low-impedance signal.

The level adjust unit 30, which is electrically coupled to the power amplifier 32, receives the filtered signal FANA from the filter/buffer 28 and generates an adjusted analog signal AAS. The level adjust unit 30 provides an adjustment for factory calibration of the circuit 10 output. Adjustment is necessary to compensate for component tolerances and to insure uniform performance.

The power amplifier 32, which is electrically coupled to a speaker 34, receives the adjusted analog signal AAS from the level adjust unit 30 and transforms it into a higher-voltage, lower-impedance signal SIG capable of driving a speaker 34.

The speaker 34 is a small, lightweight, piezoceramic device which transforms electrical power into sound with relatively high efficiency within the frequency bandwidth of the circuit 10.

After the glass break simulator 10 has generated the high-frequency sound component for one second, the control unit 12 receives the first signal OSEC. In response to the first signal OSEC, the control unit disables the memory unit 20 and the D/A converter 22, thereby stopping the generation of the high-frequency sound component.

After a second one second delay, the control unit 12 receives the second signal TSEC and reenables the threshold detector 18, whereby the glass break simulator 10 reenters the standby condition. If another low-frequency sound component is generated within the next 31 seconds (33 seconds minus the one second of high-frequency sound generation and the second one second delay), the above described process will be repeated. If another low-frequency sound component is not received, the control unit will deenergize the glass break simulator 10 (see below).

In the preferred embodiment of the present invention, the control unit 12, oscillator 14, counter chain 16, threshold detector 18, memory unit 20, D/A converter 22, microphone 24, amplifier/buffer 26, filter buffer 28, level adjust unit 30, power amplifier 32, and speaker 34 are configured as illustrated in FIG. 2.

As shown in FIG. 2, the control unit 12 comprises a pair of clocked flip-flops and combinational logic gates. The counter chain 16 comprises a set of three counters. The threshold detector 18 and the amplifier/buffer 26 are each comprised of an operational amplifier, resistors, and capacitors. The filter/buffer 28 is comprised of two operational amplifiers, resistors, and capacitors. The power amplifier 32 is comprised of an amplifier and a transformer.

If the glass break simulator 10 is configured to generate the high-frequency sound component in response to the manual command, the control unit 12 first receives a manual signal MAN from a two position flex/manual switch 42 and then enables the clock oscillator 14, the counter chain 16, the memory unit 20, and the D/A converter 22; disables the threshold detector 18 to prevent a trigger signal TRIG from being generated; and resets the counter chain 16 in the manner described above. By enabling the clock oscillator 14, the counter chain 16, the memory unit 20, and the D/A converter 22 at the same time, the high-frequency sound component is immediately generated.

As described above, after one second, the control unit 12 receives the first signal OSEC and, in response to the first signal OSEC, deenergizes the glass break simulator 10 (see below).

To configure the glass break simulator 10, the flex/-manual switch 42 is placed in either a flex or manual position. When in the flex position, the flex/manual switch 42 transmits an automatic signal AUTO to the control unit 12, thereby configuring the glass break simulator 10 to respond to a low-frequency sound component. When in the manual position, the flex/manual switch 42 generates the manual signal MAN which initiates the high-frequency sound component as described above.

To energize the glass break simulator 10, a start switch 44, which is a two-position switch having a start position and an off position, is placed in the start position. Prior to placing the start switch 44 in the start position, the circuit 10 is deenergized. When in the start position, the start switch 44, which is electrically coupled to a power control unit 36, generates a start signal SRT. The start switch 44 is placed in the start position by external force and returns to the off position as soon as the external force is removed. The start signal SRT is generated only while the start switch 44 is in the start position.

The power control unit 36, which is electrically coupled to the control unit 12, receives the start signal SRT and, in response to the start signal SRT, provides power PWR to the glass break simulator 10. The control unit 12 continually asserts the reset signal CRST until a power up reset timer 38 times out. The power up reset timer 38, which is electrically coupled to the control unit 12, generates a power up reset signal PRST a predetermined time after the power up reset timer 38 is energized. The time out function allows each component of the glass break simulator 10 to stabilize.

After the control unit 12 receives the power up reset signal PRST, the control unit 12 generates a hold signal HLD. The power control unit 36 receives the hold signal HLD and, in response to the hold signal HLD, continues to provide power PWR to the circuit 10 after the start signal SRT is removed.

As stated above, if the glass break simulator 10 does not receive a low-frequency sound component within 33 seconds (31 seconds for a second low-frequency sound component) or after one second of sound generation in the manual mode, the control unit 12 deenergizes the glass break simulator 10. To deenergize the glass break simulator 10, the control unit 12 removes the hold signal HLD.

In the preferred embodiment of the present invention, the control unit 12, flex/manual switch 42, start switch 44, tempered/plate switch 40, power control unit 36, and reset timer 38 are configured as illustrated in FIG. 2.

In addition, as shown in FIG. 2, the glass break simulator 10 also comprises a voltage regulator 50 and a battery monitor 52. The voltage regulator 50 provides stable DC supply and reference voltages to the glass break simulator 10.

The battery monitor 52 monitors a voltage of a battery (not shown) and lights an LED on a control panel (not shown) of the glass break simulator 10 when the voltage drops below a preset level. As the battery ages, the LED will flash when sound is being generated due to the momentary heavy current drain. The condition of the battery is checked by placing the simulator in Flex mode and arming the simulator 10. If the LED turns on, the battery needs replacement.

The glass break simulator 10 of the present invention is used to test the family of Model FG-730 glass break detectors. Since the Model FG-730 glass break detectors detect both a high and low-frequency sound component and the glass break simulator 10 generates only the high-frequency sound component, external means must be used to generate the low-frequency sound component to verify actual alarm performance.

The best method of generating the low-frequency sound component is simply to strike the protected glass. The low-frequency sound component of an actual glass break sound are closely related to the dimensions of the glass and the flexibility of the wall in which it is mounted; therefore, a realistic source for the low-frequency sound is available.

It should be understood that various alternatives to the structures described herein may be employed in practicing the present invention. It is intended that the following claims define the invention and that the structure within the scope of these claims and their equivalents be covered thereby.

What is claimed is:

1. An apparatus for testing a glass break detector which detects substantially simultaneously a first high-frequency sound component and a first low-frequency sound component generated by the breakage of a piece of glass, the apparatus comprising:

means for detecting a second low-frequency sound component of substantially the same frequency as the first low-frequency sound component being generated external to said apparatus and generating a first signal in response thereto; and means for generating a second high-frequency sound component of substantially the same frequency as the first high-frequency sound component in response to said first signal, wherein said second low-frequency sound component and said second high-frequency sound component are directed to the glass-break detector and the glass break detector responds to said second low-frequency sound component and said second high-frequency sound component.

2. The apparatus of claim 1 wherein said detecting means further comprises:

means for generating an electrical signal in response to said first low-frequency sound component; and means for amplifying said electrical signal to produce said first signal.

3. The apparatus of claim 1 further comprising:

means for comparing said first signal to a threshold signal and for producing a trigger signal in response thereto.

4. The apparatus of claim 3 wherein said generating means generates said second high-frequency sound component in response to said trigger signal.

5. The apparatus of claim 4 wherein said generating means further comprises:

memory means for storing digital data signals representative of a digitized sound of said second high-frequency sound component;

sequencer means for retrieving said digital data signals from said memory means;

D to A means for receiving said digital data signals and for converting said digital data signals to an analog signal; and means for receiving said analog signal and for generating said second high-frequency sound component in response thereto.

6. The apparatus of claim 5 wherein said receiving means further comprises:

means for attenuating said analog signal to produce an attenuated analog signal;

means for adjusting said attenuated analog signal to produce an adjusted analog signal;

means for amplifying said adjusted analog signal to produce a speaker signal; and means for generating said second high-frequency sound component in response to said speaker signal.

7. The apparatus of claim 5 wherein said sequencer means further comprises:

means for generating a periodic clock signal; and said memory means for outputting said digital data signals in response to said periodic clock signal.

8. The apparatus of claim 5 wherein said generating means further comprises means for preventing said second high-frequency sound component from being generated when said trigger signal is not produced within a predetermined time.

9. The apparatus of claim 8 wherein said generating means further comprises a means for stopping said generation of said second high-frequency sound component after a predetermined time.

10. The apparatus of claim 3 further comprising means for forming a second signal in response to a manual command, said generating means generating said second high-frequency sound component in response to one of said trigger and said second signal.

11. An apparatus for testing a glass break detector which detects substantially simultaneously a high-frequency sound component and a low-frequency sound component generated by the breakage of a piece of glass, the apparatus comprising:

means for detecting a second low-frequency sound component of substantially the same frequency as the first low-frequency sound component being generated external to the apparatus and for producing an electrical signal in response thereto;

means for producing a first signal in response to said electrical signal;

means for comparing said first signal to a threshold signal and for forming a trigger signal in response thereto;

means for producing a second signal in response to a manual command;

means for selecting one of said trigger signal and said second signal; and means for generating a second high-frequency sound component of substantially the same frequency as said first high-frequency sound component in response to a selected one of said trigger signal and said second signal, wherein said second low-frequency sound component and said second high-frequency sound component are directed to said glass-break detector and the glass-break detector responds to said second low-frequency sound component and said second high-frequency sound component.

12. The apparatus of claim 11 wherein said generating means further comprises:

memory means for storing digital data signals representative of a digitized sound of said second high-frequency sound component of substantially the same frequency as said first high-frequency sound component;

sequencer means for retrieving said digital data signals from said memory means;

D to A means for receiving said digital data signals and for converting said digital data signals to an analog signal; and means for receiving said analog signal and for forming said second high-frequency sound component in response thereto.

13. A method for testing a glass break detector which detects substantially simultaneously a first high-frequency sound component and a first low-frequency sound component generated by the breakage of a piece of glass, the method comprising:

striking the glass to form a second low-frequency sound component of substantially the same frequency as said first low-frequency sound component;

detecting said second low-frequency sound component;

generating a first signal in response to the detection of said second low-frequency sound component; and generating a second high-frequency sound component of substantially the same frequency as said first high-frequency sound component in response to said first signal wherein the second low-frequency sound component and the second high-frequency sound component are directed to the glass-break detector and the glass-break detector responds to said second low-frequency sound component and said second high-frequency sound component.

14. The method of claim 13 further comprising:

comparing said first signal to a threshold signal; and producing a trigger signal in response to said comparison.

15. The method of claim 14 wherein said generating step generates said second high-frequency sound component in response to said trigger signal.

16. The method of claim 15 wherein said generating step further comprises:

producing a data signal in response to said trigger signal;

converting said data signal into an analog signal;

attenuating said analog signal to produce an attenuated analog signal;

amplifying said attenuated analog signal to produce a speaker signal; and producing said second high-frequency sound component in response to said speaker signal.

17. The method of claim 16 wherein said generating step further comprises:

preventing said second high-frequency sound component from being generated when said trigger signal is not produced within a predetermined time; and stopping said generation of said second high-frequency sound component after a predetermined time.

* * * * *